US010358282B1

(12) United States Patent
Strickler

(10) Patent No.: US 10,358,282 B1
(45) Date of Patent: Jul. 23, 2019

(54) CIGARETTE PACKAGE

(71) Applicant: GRIP, LLC, Portland, OR (US)

(72) Inventor: Jesse O. Strickler, Medford, OR (US)

(73) Assignee: GRIP, LLC, Medford, OR (US)

( * ) Notice: Subject to any disclaimer, the term of this patent is extended or adjusted under 35 U.S.C. 154(b) by 0 days.

(21) Appl. No.: 15/897,906

(22) Filed: Feb. 15, 2018

(51) Int. Cl.

| | |
|---|---|
| ***B65D 85/10*** | (2006.01) |
| ***B65D 53/04*** | (2006.01) |
| ***B65B 31/02*** | (2006.01) |
| ***B65B 19/12*** | (2006.01) |

(52) U.S. Cl.
CPC ..... *B65D 85/10* (2013.01); *B65B 19/12* (2013.01); *B65B 31/025* (2013.01); *B65D 53/04* (2013.01); *B65D 2101/0023* (2013.01)

(58) Field of Classification Search
CPC ..... B65D 85/10; B65D 53/04; B65D 2101/0023; B65B 18/12; B65B 31/025
USPC ..... 206/242–276
See application file for complete search history.

(56) References Cited

U.S. PATENT DOCUMENTS 1,373,577 A * 4/1921 Vallens ..... B65D 85/12 206/256
1,426,792 A * 8/1922 Vallens ..... B65D 85/12 206/242
3,346,135 A * 10/1967 Haitsch ..... B65D 51/26 206/265
4,122,964 A * 10/1978 Morris ..... B65D 51/145 215/200
4,250,994 A 2/1981 Focke
4,935,274 A * 6/1990 DeBenedictis ..... B32B 27/08 428/36.7
5,354,569 A 10/1994 Brown et al.
5,881,868 A * 3/1999 Soyak ..... A24F 15/00 206/213.1
5,945,147 A 8/1999 Borchard
7,124,883 B1 * 10/2006 Thomas ..... B65D 43/162 206/256
7,798,319 B1 * 9/2010 Bried ..... A24F 23/00 206/242
8,863,947 B2 * 10/2014 Sibley ..... B65B 61/20 206/213.1
9,096,336 B2 8/2015 Maas et al.
9,162,783 B2 * 10/2015 Ancona ..... B65B 19/30
(Continued)

OTHER PUBLICATIONS

Pre Rolled Joint Tubes. biohazardinc.com/joint-and-blunt-tubes/joint-tube-small.html. Last Accessed Jan. 29, 2018.
(Continued)

*Primary Examiner* — Chun Hoi Cheung
(74) *Attorney, Agent, or Firm* — SoCal IP Law Group LLP; Guy Cumberbatch; Steven C. Sereboff

(57) ABSTRACT

A packaged assembly of a hermetically sealed container and cigarette, and method of forming the assembly. The container is hermetically sealed for airtight conditions for freshness, whereby an interior space is either filled with an inert gas or is evacuated down to a pressure close to 0 atm to remove substantially all air (oxygen) from within. The container may be clear glass to afford good visibility of the cigarette within an interior space thereof. However, a relatively large label may be affixed to the exterior of the container to occlude most of the light from reaching the cigarette.

11 Claims, 2 Drawing Sheets

(56) References Cited

U.S. PATENT DOCUMENTS

| | | | | |
|---|---|---|---|---|
| 2005/0211657 | A1* | 9/2005 | Mallet | B65D 41/045 215/252 |
| 2007/0000801 | A1* | 1/2007 | Mauran | A61F 2/1664 206/438 |
| 2010/0006532 | A1* | 1/2010 | Lee | B65D 53/04 215/349 |
| 2012/0111745 | A1* | 5/2012 | Stephenson | B65D 81/2053 206/242 |
| 2015/0181933 | A1* | 7/2015 | Clark | A24F 15/00 206/265 |

OTHER PUBLICATIONS

Pre Rolls—Caviar Gold. https://caviargold.com/pre-rolls/ Last Accessed Jan. 29, 2018.

Tipton, Meghan. "5 Reasons Why Prerolled Joints Are a Gamechanger." Eaze Blog | Marijuana Education, News, and Culture, Dec. 29, 2017, www.eaze.com/blog/posts/5-reasons-prerolls. Last Accessed Jan. 29, 2018.

Noall, R.R. Here's Everything You Need to Know About Cavi Cones, Apr. 27, 2017, herb.co/marijuana/news/cavi-cones. Last Accessed Jan. 29, 2018.

MrMookster420. "Jays Joint Delivery." CC Forums, Dec. 20, 2004, http://forums.cannabisculture.com/forums/index.php?/topic/101363-jays-joint-delivery/. Last Accessed Jan. 29, 2018.

Glass Pre-Roll Tubes, www.kushbottles.com/products/Glass-Pre-Roll-Tubes. Last Accessed Jan. 29, 2018.

Stusser, Michael A. "The High End: The Best in Pre-Roll Branding." PRØHBTD, prohbtd.com/joints-spliffs-doobies-and-fatties-the-best-pre-roll-packaging. Last Accessed Jan. 29, 2018.

* cited by examiner

CIGARETTE PACKAGE

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

Field

This disclosure relates to cigarette packaging.

Description of the Related Art

Cigarettes are formed of a thin, flat, burnable wrapper which encases an herbaceous substance. The herbaceous substance may be tobacco, cannabis or herbs such as cloves. Cigarettes are consumed by smoking, though some forms involve inhaling while others do not. Cigarettes may be produced manually, such as by the end user, or by a machine. Conventionally, a user deposits loose herbaceous combustible material in a line parallel to a long dimension of a cigarette paper, generally opposite to a gummed edge. By folding over and then rolling the ungummed edge around the line of combustible material, a cylindrical cigarette is formed which is held together by securing the gummed edge to the exterior of the outer layer of paper. Machines which perform the function are well known, including fully automated machines in use for many years to manufacture tobacco cigarettes, as well as more recently automatic, semi-automatic and manual machines available to roll cannabis joints, see http://weedshome.com/top-10-rolling-machines. Many vendors now offer so-called "pre-rolled" joints for those unable or unwilling to roll themselves. Such pre-rolled joints are often formed by filling a pre-formed conical cigarette paper ("cones") with loose leaf from the large diameter end and then sealing or twisting the end closed.

In general, freshness is highly desirable in a cigarette. Not only does oxygen eventually degrade the quality of the herbaceous substance, but exposure to light also affects aspects such as moisture content, color and taste. Consequently, there is a need for an improved way to store and ship cigarettes.

Throughout this description, elements appearing in figures are assigned three-digit reference designators, where the most significant digit is the FIG. number where the element is introduced and the two least significant digits are specific to the element. An element that is not described in conjunction with a FIG. may be presumed to have the same characteristics and function as a previously-described element having the same reference designator.

DETAILED DESCRIPTION

A packaged assembly of a hermetically sealed container and cigarette, and method of forming the assembly are disclosed. The container may be glass and hermetically sealed for airtight conditions. The hermetically sealed interior space within the container may be filled with an inert gas, or evacuated down to a pressure close to 0 atm to remove substantially all air from within. The container may be clear to afford good visibility of the cigarette within an interior space thereof. A relatively large label may be affixed to the exterior of the container to occlude most of the light from reaching the cigarette. The label may include product information, branding, designs, warnings, etc.

Figure 1A:
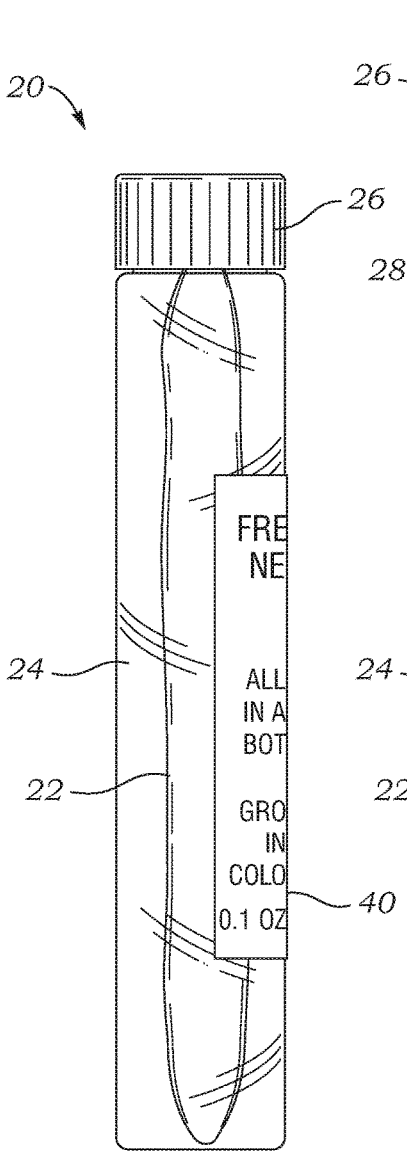
FIG. 1A is a side view of a packaged cigarette.
Figure 1B:
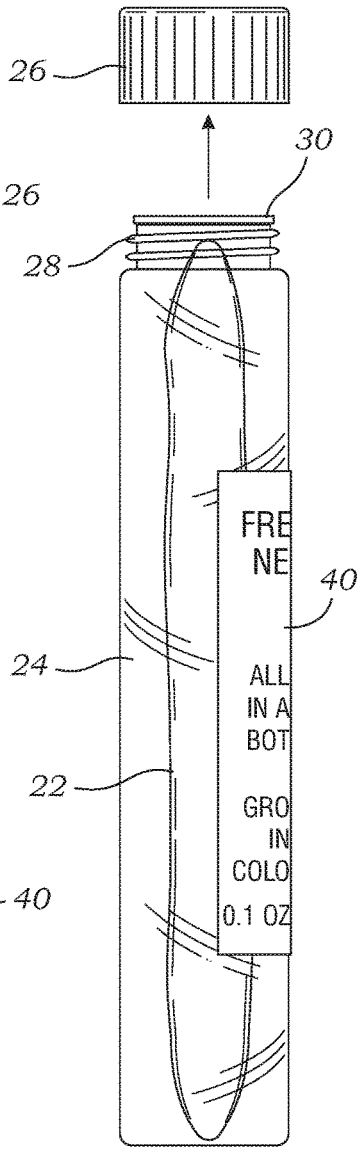
FIG. 1B is a side view of the packaged cigarette of FIG. 1 with an exterior cap removed.

FIG. 1A is a side view of a package 20 for a cigarette 22. Providing the container 24 as a narrow cylinder enables packaging of one or more cigarettes therein, typically one or two. The package 20 comprises a rigid-sided container 24 which may be glass topped with an exterior cap 26. FIG. 1B is a side view of the package of FIG. 1 with the exterior cap 26 removed. The cap 26 may have internal threads (not shown) that mate with external threads 28 on an upper mouth 29 of the container 24.

Figure 1C:
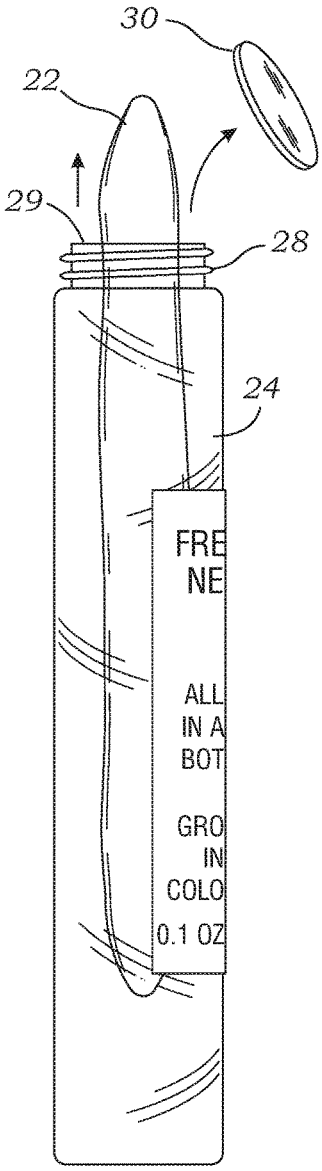
FIG. 1C is a side view of the packaged cigarette of FIG. 1 with the exterior cap and an interior seal removed, and showing removal of the cigarette therefrom.

A seal 30 is in contact around the open mouth 29 and sealing the interior space of the container from the surrounding atmosphere. The container 24 may be a narrow tube with a closed end opposite a circular open mouth 29 just beyond the external threads 28, and the seal 30 may be elastomeric and a circular solid disk. The seal 30 may be made of various elastomers such as silicone rubber, polyurethane, natural rubber, Polybutadiene, or the like. The seal 30 has a thickness which resists collapse and may be selected so as to remain relatively planar over the open mouth 29. FIG. 1C is a side view of the sealed package 20 with the exterior cap 26 and the interior seal 30 removed, showing removal of the cigarette 22 therefrom.

The seal 30 hermetically seals the interior space within the container 24 which permits the cigarette 22 to be stored in an oxygen-free environment to preserve freshness. An oxygen-free environment may be established by evacuating substantially all the oxygen within the container or by introducing a majority of inert gas within the container, which displaces the ambient air. Common inert gasses which may be used include nitrogen, argon, and helium. $CO_2$ may also be used which, though it has oxygen atoms, maintains freshness of cigarettes in a similar manner since the oxygen is not free but instead is covalently double bonded with the carbon atom in the $CO_2$ molecule.

Freshness of the cigarette in the package may be disclosed to the consumer in a number of ways. Removal of the seal 30 may cause a sudden pressure rise within the container resulting in an audible sound, such as a brief hiss or a pop. The audible sound alerts the consumer to the fact that the seal of the interior space was intact, evidencing maximum freshness. A strip of oxygen-sensitive paper or other material may be included within the container 24 which turns a different color in the presence of oxygen, such as when the seal 30 is disturbed. A pressure-sensitive indicator such as a small pouch or the like may be placed in the container 24 which becomes inflated when a vacuum is created in the container and deflates when the seal 30 is broken. A tamperresistant indicator may be used, such as a heat shrink wrapper around the exterior cap 26 which must be destroyed before opening the container 24.

The cigarette 22 may be made of one or more of tobacco, dried leaves such as stinging nettle or jimson weed, marijuana and other forms of smokable cannabis, or herbs such cloves. The cigarette paper is typically made fromand lightweight "rag fibers" (nonwood plant fibers) such as flax, hemp, sisal, rice straw, and esparto. The paper is available in rolls and rectangularsheets of varying sizes, and has a narrow strip of glue along one long edge. Consequently, to be clear the term "cigarette" pertains to any and all products having loose leaf material within a cylindrical or conical combustible outer wrapper/paper, using cannabis, other herbs, tobacco, or mixtures thereof.

Figure 2:
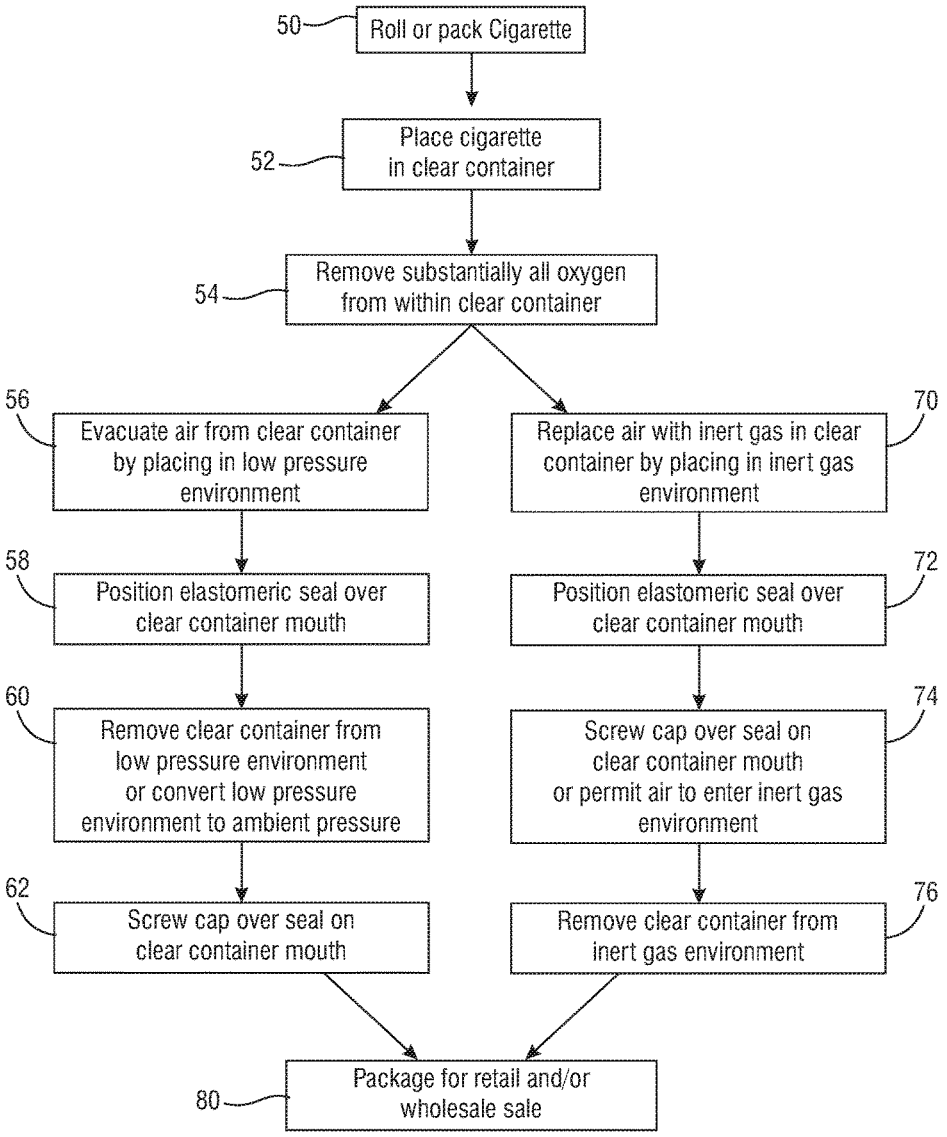
FIG. 2 is a flowchart showing a process of assembling a packaged cigarette.

FIG. 2 is a flowchart showing a process of assembling a packaged cigarette such as the sealed package 20. In initial step 50, a cigarette is formed by hand or with the use of a machine, either by rolling or filling a pre-rolled cone, e.g. Subsequently, in step 52, one or more cigarettes are placed within the clear rigid container (preferably clear glass). The next step 54 of removing substantially all of the oxygen from within the container may be performed in one of several ways, two of which are shown in diverging branches.

In a first method, step 56 commences by evacuating air from the glass container. This may be accomplished by placing the container in a larger enclosed space or chamber and pulling a vacuum so that the environment within the enclosed space experiences a reduction in pressure. The vacuum may be as near to 0 atm as possible to ensure substantially all of the oxygen has been removed.

Step 58 involves placing an elastomeric seal over the open mouth of the container while the container is still in the low pressure environment. Subsequently, in step 60, the assembler removes the container from the low pressure environment which creates a pressure differential between the inside and the outside of the container and consequently pulls the seal down over the open mouth. Alternatively, the evacuated chamber may simply be brought back up to ambient pressure with the container(s) still inside. The pressure differential pulls the elastomeric seal firmly down around the container mouth and the elastomeric material deforms to an extent to conform around and seal against the mouth. Finally, in step 62 an exterior cap is added over the container mouth which conceals and protects the elastomeric seal.

In a second method, step 70 involves removing substantially all of the oxygen from within the container by replacing air with a gas such as an inert gas, for example by placing the glass container in an inert gas environment/chamber. Alternatively, the free oxygen atoms may be removed by evacuation prior to filling the chamber with a gas. After a short period, all of the air has been replaced with the inert gas. Then, in step 72, a seal is placed over the open mouth of the container while the container is still in the inert gas environment. Step 74 includes adding an exterior cap over the container mouth which conceals and protects the elastomeric seal. Step 74 may be performed while the container remains in the inert gas environment, to avoid allowing any air (oxygen) to seep back into the container. If the chamber has previously been evacuated to a low or 0 atm pressure, reintroducing atmospheric conditions to the chamber prior to adding the cap will cause the seal to press against the container mouth, thus sealing the gas inside. Finally, the assembler removes the sealed and capped container from the inert gas environment in step 76.

Step 80 is common to either method of sealing the container without oxygen, and involves packaging the containers for retail and/or wholesale sale. If glass is used for the container, rigid and cushioned outer packaging may be used to prevent breakage.

Closing Comments

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

It is claimed:

1. An assembly comprising:

a) a container with rigid walls and an open mouth at one end and closed at the other end, the walls including a transparent region, b) a cigarette positioned within an interior space of the container and visible from outside the container, c) an absence of substantially all free oxygen atoms and a majority of an inert gas within the container, d) a hermetic seal in contact around the open mouth and sealing the interior space of the container from the surrounding atmosphere at a pressure below ambient pressure, and e) a rigid cap secured to the container mouth over the seal.

2. The assembly of claim 1 wherein the cap is in contact with the seal.

3. The assembly of claim 1 wherein the seal is elastomeric.

4. The assembly of claim 3 wherein the seal is made of silicone rubber.

5. The assembly of claim 1 wherein the container is glass.

6. The assembly of claim 1 wherein the container is a narrow tube that has an interior space slightly larger than the cigarette.

7. The assembly of claim 1 wherein the gas is one or more of nitrogen, argon and helium.

8. The assembly of claim 1 wherein the entire container is transparent.

9. The assembly of claim 1 further comprising an opaque label attached to the container.

10. A method of making the assembly of claim 1, comprising:

a) placing the cigarette within the interior space of the container, b) placing the hermetic seal in contact around the open mouth, c) locating the container and cigarette within a chamber, d) evacuating substantially all free oxygen atoms in the chamber, e) introducing the inert gas into the chamber at a pressure below ambient pressure, f) bringing the chamber back up to ambient pressure so as to pull the hermetic seal firmly down around the container mouth to deform and seal against the mouth, g) removing the container and cigarette with the hermetic seal thereover from the chamber, and h) securing the rigid cap to the container mouth over the seal.

11. A method of making the assembly of claim 1, comprising:

a) placing the cigarette within the interior space of the container, b) evacuating the container of substantially all free oxygen atoms, c) placing the hermetic seal in contact around the open mouth, d) introducing the inert gas into the container at a pressure below ambient pressure, e) bringing the chamber back up to ambient pressure so as to pull the hermetic seal firmly down around the container mouth to deform and seal against the mouth, and f) securing the rigid cap to the container mouth over the seal.

* * * * *